US007491085B2

(12) United States Patent
Lappoehn

(10) Patent No.: US 7,491,085 B2
(45) Date of Patent: Feb. 17, 2009

(54) RIBBON CABLE PLUG-IN CONNECTOR

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 12/072,325

(22) Filed: Feb. 26, 2008

(65) Prior Publication Data

US 2008/0207044 A1 Aug. 28, 2008

Related U.S. Application Data

(63) Continuation of application No. 11/465,318, filed on Aug. 17, 2006, now abandoned.

(30) Foreign Application Priority Data

Aug. 19, 2005 (DE) ..... 10 2005 039 620

(51) Int. Cl.
*H01R 12/24* (2006.01)

(52) U.S. Cl. ..... 439/499

(58) Field of Classification Search ..... 439/607, 439/108, 638, 492, 495, 499, 497
See application file for complete search history.

(56) References Cited

U.S. PATENT DOCUMENTS

| | | | | |
|---|---|---|---|---|
| 3,337,834 | A | 8/1967 | Goodwin et al. | |
| 4,420,201 | A | 12/1983 | Stephenson | |
| 4,577,920 | A | 3/1986 | Coldren et al. | |
| 4,589,200 | A | 5/1986 | Burgit et al. | |
| 4,619,487 | A * | 10/1986 | Brush, Jr. | 439/98 |
| 4,687,263 | A * | 8/1987 | Cosmos et al. | 439/108 |
| 6,315,616 | B1 * | 11/2001 | Hayashi | 439/638 |
| 6,623,301 | B2 | 9/2003 | Lappoehn | |
| 6,648,683 | B2 * | 11/2003 | Youtsey | 439/578 |
| 6,655,992 | B1 * | 12/2003 | Ko | 439/579 |

FOREIGN PATENT DOCUMENTS

| | | |
|---|---|---|
| DE | 101 19 695 | 11/2002 |
| EP | 0 135 122 | 3/1985 |
| GB | 2 140 227 | 11/1984 |

OTHER PUBLICATIONS

Meinke et al., "Taschenbuch der Hochfrequenztechnik," Springer-Verlag, 1956, pp. 6-11. (Spec, p. 2).

* cited by examiner

*Primary Examiner*—Alexander Gilman
(74) *Attorney, Agent, or Firm*—Collard & Roe, P.C.

(57) ABSTRACT

A ribbon cable plug-in connector (10) for connecting electronic components includes a plurality of plug-in contacts (14*a*, 14*b*) arranged in a plug-in connector element (11). A contact element (12*a*, 12*b*) arranged on the plug-in connector element (11) is provided for full-surface contact-making with an electrically conductive ribbon cable shielding (17, 17*a*, 17*b*) which encloses the ribbon cable (16) on its outside. For fixing the ribbon cable shielding (17, 17*a*, 17*b*) on the contact element (12*a*, 12*b*) there is preferably provided at least one clamping element (15*a*, 15*b*), which is given a resilient configuration. The ribbon cable plug-in connector (10) according to the invention allows contact between the ribbon cable shielding (17, 17*a*, 17*b*) and the ribbon cable plug-in connector (10) to be easily established and ensures a high shielding level.

5 Claims, 3 Drawing Sheets

RIBBON CABLE PLUG-IN CONNECTOR

CROSS REFERENCE TO RELATED APPLICATIONS

This application is a continuation and claims priority under 35 U.S.C. §120 of U.S. patent application Ser. No. 11/465,318 filed Aug. 17, 2006, now abandoned which claims priority under 35 U.S.C. §119 of German Application No. 10 2005 039 620.8 filed Aug. 19, 2005, which are incorporated by reference herein.

BACKGROUND OF THE INVENTION

1. Field of the Invention

The present invention relates to a ribbon cable plug-in connector for connecting electronic components.

2. Prior Art

DE 101 19 695 A1 describes a plug-in connector where each of the two connector elements is provided with shielding plates. In the plugged condition of the two connector elements, the shielding plates are in substantially full-surface contact one with the other. The plug-in connector comprises a plurality of plug-in contacts, arranged in the form of two banks, which are configured as pin contacts and slot contacts.

A possibility to make contact with a ribbon cable shielding, if any, of a ribbon cable connected with a plug-in connection element is not provided. In practice, such a connection is established, for example, by the steps of lifting the shielding, which encloses the ribbon cable, partially off the ribbon cable, twisting it at a predetermined point, for example, and then soldering it to a contact arranged on a printed wiring board external to the plug-in connector. If the plug-in connector is to be detached later, this is possible only by either separating or unsoldering the ribbon cable shielding.

For making contact with the outer conductor, which coaxially encloses the inner conductor, sockets or plugs of coaxial cables known in radio frequency technology comprise a tubular contact element, by means of which full-surface contact is established with the outer conductor, the latter having first been lifted off the insulation of the inner conductor. Fixing of the outer conductor on the contact element is effected by screwing down the outer connector shell. The outer conductor performs not only the function of a return line, but also the function of a shielding. In addition to ensuring a predetermined shielding level, the structure of the coaxial cable also guarantees a predefined surge impedance.

From the relevant basic literature, for example a textbook entitled "Taschenbuch der Hochfrequenz-Technik", Meinke H. and Gundlach F. W., Springer-Verlag 1956, pp. 6-11, approximation formulas have been known for determining the inductance of conductor arrangements having different geometric configurations. Accordingly, a conductor arrangement having a rectangular cross-section, for example, has a lower inductance than a conductor that has a circular cross-section.

In computer technology, ribbon cable plug-in connectors for connecting drive controllers to the corresponding drives are known that used to comprise 40 lines, for example. As the data transfer rate increased, a need for a shielding arose which need is satisfied today by ribbon cables which now comprise 80 lines, for example, with a signal line and a shielding line associated to the signal line provided in alternate arrangement. All lines, including the shielding lines, are contacted individually in the plug-in connection element, for example using insulation-piercing contact devices.

Now, it is the object of the present invention to provide a ribbon cable plug-in connector that allows contact to a ribbon cable shielding to be made in a simple way.

SUMMARY OF THE INVENTION

The ribbon cable plug-in connector according to the invention for connecting electronic components comprises a plug-in connector element that comprises a plurality of plug contacts. The ribbon cable plug-in connector further comprises a first contact element arranged on the plug-in connector element for full-surface contact-making with an electrically conductive ribbon cable shielding that encloses an outside surface of a ribbon cable. The ribbon cable plug-in connector comprises further at least one clamping element cut out of the first contact element for fixing the ribbon cable shielding.

The at least one clamping element of the ribbon cable plug-in connector according to the invention is given a resilient configuration. The at least one clamping element is bent out of and lifted away from the plane of the first contact element. The lifting overcomes the resilient force provided by the resilient configuration of the at least one clamping element. Upon positioning the conductive ribbon cable in between the at least one clamping element and the first contact element and releasing the at least one clamping element, the conductive ribbon cable shielding is clamped between the at least one clamping element and the first contact element after the contacting due to the resilient force provided by the resilient configuration of the at least one clamping element.

The ribbon cable plug-in connector according to the invention allows especially easy contact-making between the ribbon cable shielding and the ribbon cable plug-in connector. A substantial advantage further lies in the fact that the ribbon cable plug-in connector provides a high shielding level because on the one hand the ribbon cable shielding encloses the ribbon cable almost up to the ribbon cable plug-in connector according to the invention, while on the other hand the contact element takes over the shielding function for that portion of the ribbon cable where the ribbon cable shielding has been removed from the ribbon cable. Due to the structure of both the contact elements and the ribbon cable shielding low inductance is achieved for the entire arrangement, which permits the arrangement to be linked to a circuit ground that remains in the low impedance range even at higher frequencies.

The resilient configuration of the at least one clamping element facilitates the connection of the conductive ribbon cable shielding with the first contact element. During assembly of the ribbon cable plug-in connector the at least one clamping element is bent out of and lifted away from the plane of the first contact element whereby the ribbon cable shielding can be pushed into its position below the at least one clamping element. After the release of the at least one clamping element, the at least one clamping element presses the ribbon cable shielding against the first contact element due to the resilient force provided by the resilient configuration of the at least one clamping element so that reliable contact is guaranteed.

Further, the strain loading capacity of the ribbon cable plug-in connector contacted by the ribbon cable shielding is increased.

Advantageous further developments and configurations of the ribbon cable plug-in connector according to the invention will be apparent from the further embodiments.

According to one embodiment, the ribbon cable plug-in connector further comprises a second contact element whereby the first contact element is arranged on a first side of a ribbon cable bushing provided in the plug-in connector element and whereby said second contact element being arranged on a second side of the ribbon cable bushing. The first and second contact elements are contacting a portion of the ribbon cable shielding on an upper surface of the ribbon cable or a lower surface of the ribbon cable, respectively. With the aid of that feature, contact is made between almost the entire ribbon cable shielding and the contact element.

One embodiment provides that the contact element is arranged adjacent to the ribbon cable bushing provided in the plug-in connector element. It is ensured in this way that the shielding function is taken over, in the area of the ribbon cable bushing, directly by the contact element.

According to one embodiment, the contact element comprises at least one recess, and the ribbon cable shielding is pressed into the latter, and is keyed therein, by the clamping element. The recess contributes especially toward increasing the mechanical stability of the contact between the ribbon cable shielding and the contact element. The fact that the ribbon cable shielding is pressed into the recess at least in part, and is keyed therein, provides especially efficient fixing.

Advantageously the at least one recess is formed by cutting and bending the clamping element out of the first or the second contact element, respectively.

Other advantageous developments and embodiments of the ribbon cable plug-in connector will become apparent from the description that follows.

DETAILED DESCRIPTION OF THE PREFERRED EMBODIMENTS

Figure 1:
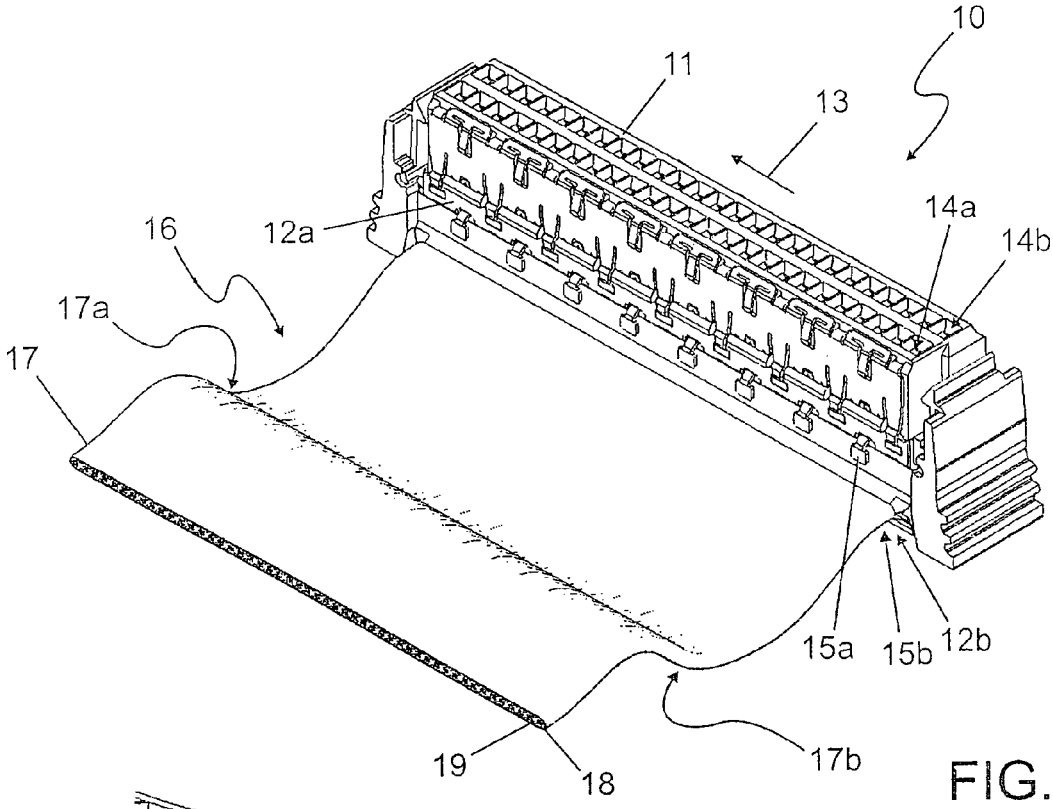
FIG. 1 shows a perspective view of a ribbon cable plug-in connector according to the invention.

FIG. 1 shows a perspective view of a ribbon cable plug-in connector 10 according to the invention having a plug-in connector element 11 on which a first contact element 12*a* is arranged that extends in the longitudinal direction 13 of a plurality of plug-in contacts 14*a*, 14*b*—not visible in FIG. 1—arranged one beside the other.

At least one first clamping element 15*a* is provided for fixing an electrically conductive ribbon cable shielding 17 that encloses a ribbon cable 16. The ribbon cable shielding 17 comprises a first portion 17*a* on an upper surface of the ribbon cable and a second portion 17*b* on a lower surface of the ribbon cable.

The ribbon cable shielding 17 encloses a plurality of lines 18, each of which is enclosed by a line insulation 19.

The first portion 17*a* of the ribbon cable shielding 17, on the upper surface of the ribbon cable 16, is contacted by the first contact element 12*a* and is fixed by the at least one clamping element 15*a*. The second portion 17*b* of the ribbon cable shielding 17, on the lower surface of the ribbon cable 16, is contacted by the second contact element 12*b*, not visible in FIG. 1, and is fixed by at least one clamping element 15*b*, which likewise is not visible in FIG. 1.

Figure 2:
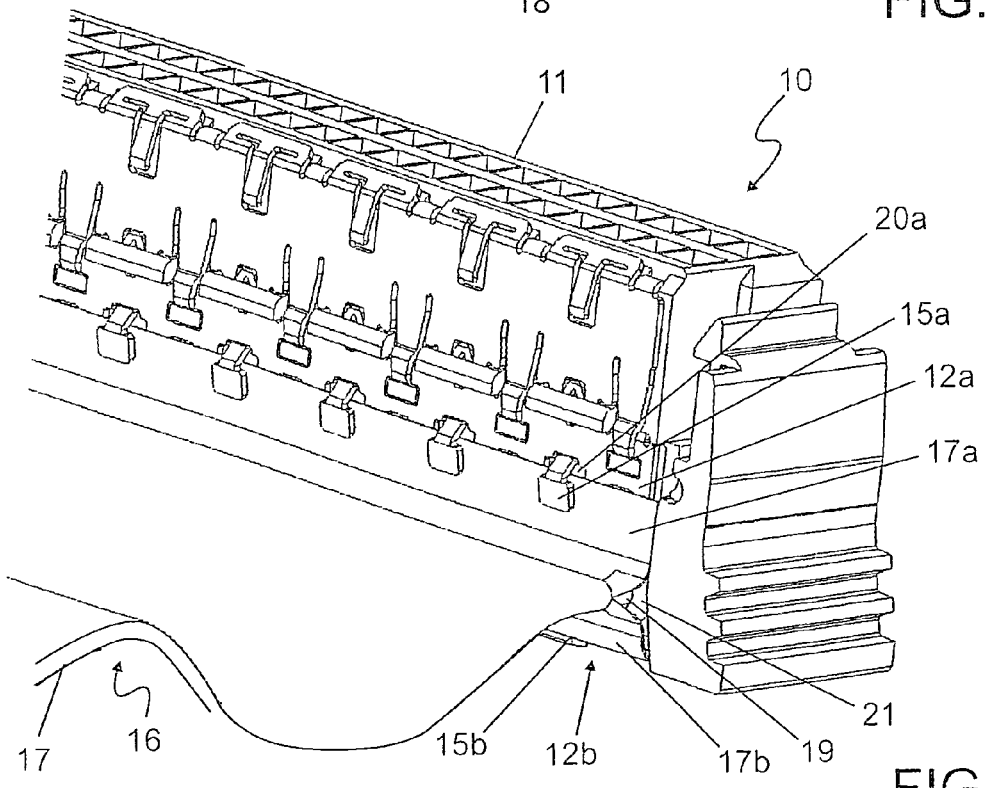
FIG. 2 shows a detailed illustration according to FIG. 1.

FIG. 2 shows a detail of the ribbon cable plug-in connector 10 illustrated in FIG. 1. In FIG. 2, those parts that conform to the parts illustrated in FIG. 1 are designated by the same reference numerals. FIG. 2 illustrates the way in which the first portion 17*a* of the ribbon cable shielding 17 is contacted by the first contact element 12*a* and the second portion 17*b* of the ribbon cable shielding 17 is contacted by the second contact element 12*b*, which is not visible in FIG. 2.

The first portion 17*a* of the ribbon cable shielding 17 is fixed by the at least one first clamping element 15*a* on the first contact element 17*b*, while the second portion 17*b* of the ribbon cable shielding 17 is fixed by the at least one second clamping element 15*b* on the second contact element 12*b*.

A first recess 20*a* is provided in the first contact element 12*a*, in the area of the first clamping element 15*a*.

The lines 18 enclosed by the line insulations 19 are guided into the plug-in connection element 11 through a ribbon cable bushing 21.

Figure 3:
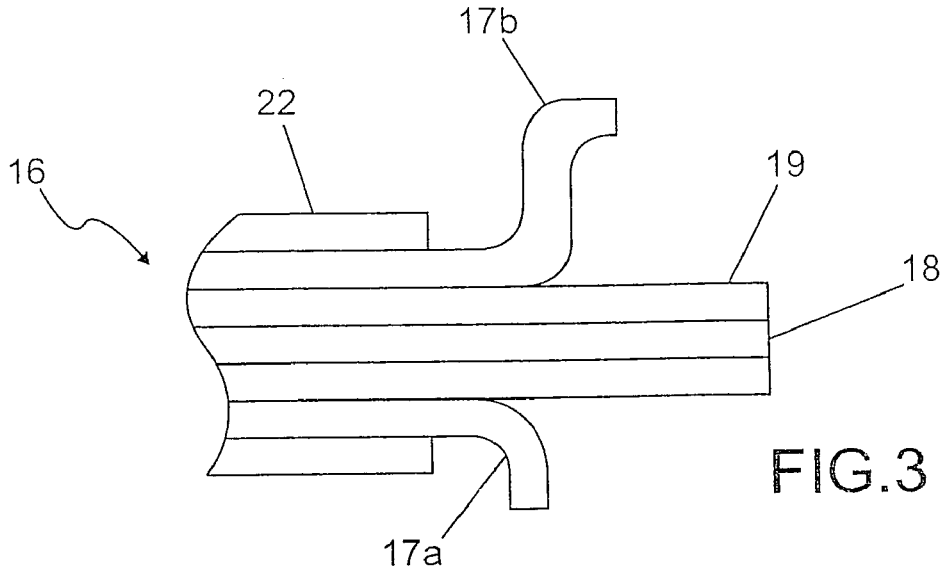
FIG. 3 shows a sectional view of a ribbon cable prepared for contact-making.

FIG. 3 shows a sectional view of the ribbon cable 16, prepared for being contacted by the first and the second contact elements 12*a*, 12*b*. An outer insulation 22, not shown in FIGS. 1 and 2, which surrounds the ribbon cable 16 on its outside, is indicated beside the conductor 18 and its insulation 19 and beside the first and the second portions 17*a*, 17*b* of the ribbon cable shielding 17.

Figure 4:
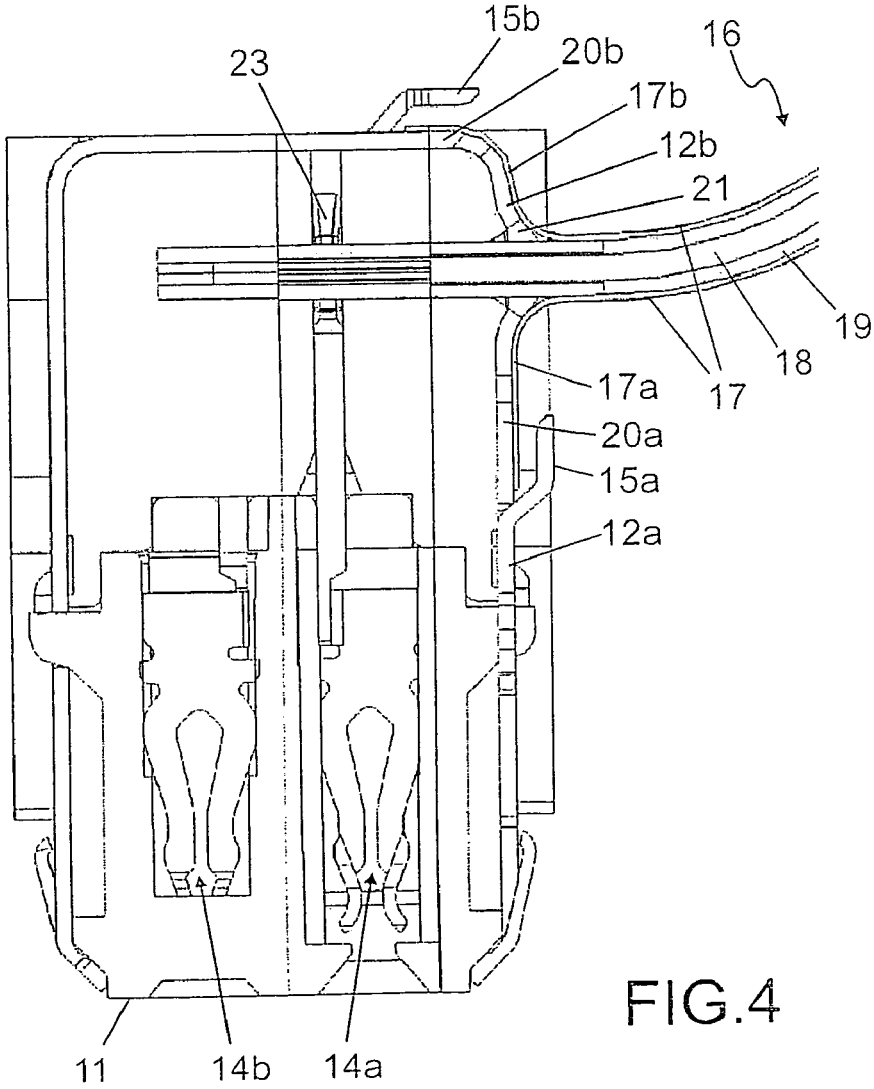
FIG. 4 shows a sectional view of a ribbon cable plug-in connector according to the invention, prior to fixing a ribbon cable shielding.
Figure 5:
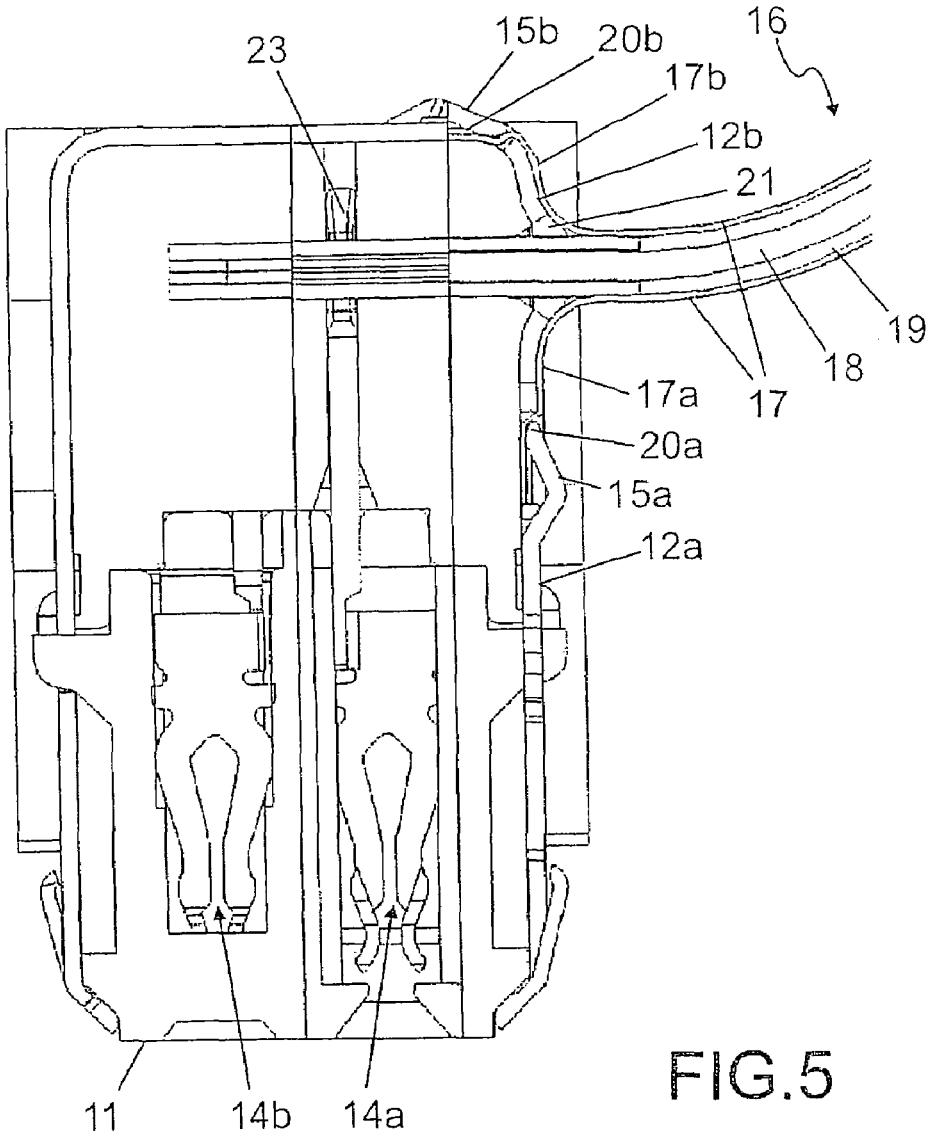
FIG. 5 shows a sectional view of a ribbon cable plug-in connector according to the invention, after fixing of a ribbon cable shielding.

FIGS. 4 and 5 show sectional views of the plug-in connector element 11, along a line passing through the ribbon cable bushing 21. In FIGS. 4 and 5, those parts that conform to the parts shown in the previous Figures, are again indicated by the same reference numerals. FIG. 4 shows the way in which the first portion 17*a* of the ribbon cable shielding 17 is contacted by the first contact element 12*a* and in which the second portion 17*b* of the ribbon cable shielding 17 is contacted by the second contact element 12*b*, prior to being fixed by the first and the second clamping elements 15*a*, 15*b*, respectively, while FIG. 5 shows the situation after fixing.

In FIGS. 4 and 5, a second recess 20*b*, arranged in the second contact element 12*b*, is indicated in addition to the first recess 20*a*. Further, the illustration shows an insulation-piercing contact device 23 of the plug-in connector 14*a*, intended for establishing contact with the lines 18 of the ribbon cable 16.

Figure 6:
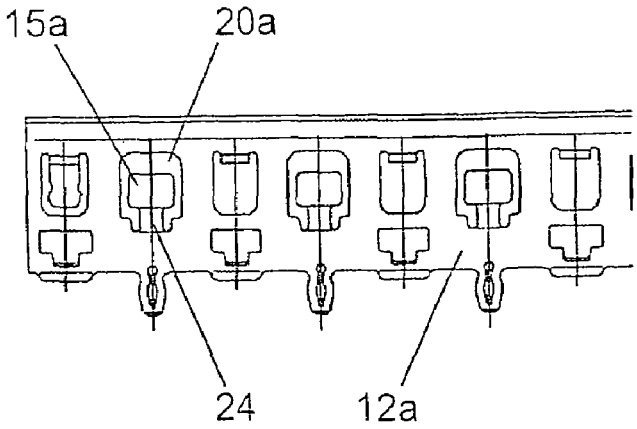
FIG. 6 shows a contact element.

FIG. 6 shows the first contact element 15*a*, formed for example as a punching. The at least one recess 20*a* advantageously has been punched out, and the part so punched out in part can be bent or away from the plane of the first contact element 15*a*, at least somewhat, may be bent at least slightly at an angle so as to form the first clamping element 15*a*. The clamping element 15*a* comprises a narrower portion 24 between the punched-out clamping element 15*a* and the contact element 12*a*.

The ribbon cable plug-in connector 10 comprises the plug-in connector element 11, in which a plurality of plug-in contacts 14*a*, 14*b* are arranged in the longitudinal direction 13 and by means of which the lines 18 of the ribbon cable 16 are to be contacted. A plurality of the plug-in contacts 14*a*, 14*b* are shown in the Figures, arranged one beside the other, although the plug-in contacts 14*a*, 14*b* may also be set off—not shown in the drawing—in a direction perpendicular to the longitudinal direction 13. The plug-in contacts 14*a*, 14*b* are implemented, for example, as slot contacts, corresponding to pin contacts arranged in the other portion of a corresponding plug-in connector element, not shown in the drawing.

The ribbon cable plug-in connector 10 is intended for connecting electronic components by means of a ribbon cable 16.

The ribbon cable 16 comprises a plurality of lines 18, arranged one beside the other, that are enclosed by line insulations 19. The ribbon cable shielding 17, which preferably encloses the ribbon cable 16, is provided as a common shielding for the lines 18. The ribbon cable shielding 17 may be produced, for example, from a wire mesh. The mesh may consist, for example, of a copper braiding which is tin-plated. According to another embodiment, the ribbon cable shielding 17 is implemented as a continuous conductive film, for example as a copper film.

The ribbon cable shielding 17 acts to attenuate any undesirable radiation of electric signals that are transmitted via the lines 18. Likewise, any undesirable input coupling of external radiation into the lines 18 is diminished. The radiation in question may, for example, be an electromagnetic radiation or a predominantly electric field or a predominantly magnetic field.

As part of the assembly of the ribbon cable plug-in connector 10 to the ribbon cable 16, the ribbon cable shielding 17 is lifted off the line insulation 19 and is bent off away from the ribbon cable 16, at least in the area of the ribbon cable bushing 21.

In contrast to the way contact is made with the ribbon cable shielding 17 in the prior art, which was accompanied by a considerable deterioration of the shielding effect and by considerable assembly effort, the arrangement according to the invention comprises at least one contact element 12*a*, 12*b* arranged on the plug-in connector element 11, which extends in the longitudinal direction 13 of the plug-in contacts 14*a*, 14*a* and which is intended to make contact with the ribbon cable shielding 17, 17*a*, 17*b*. Preferably, the contact element 12*a*, 12*b* extends over the full width of the ribbon cable 16 and the ribbon cable shielding 17, 17*a*, 17*b*, respectively.

The ribbon cable plug-in connector 10 according to the invention is easy to assemble and additionally guarantees efficient shielding. In addition to the ribbon cable shielding 17, the contact element 17*a*, 17*b* likewise takes part in shielding the plug-in connector 11. The specific configuration of the contact element 12*a*, 12*b*, extending in the longitudinal direction 13 of the plug-in connector element 11, leads to low inductance of the arrangement, corresponding to low surge impedance, so that the interfering signals will be diverted to an electric circuit ground with low impedance, up to high frequencies.

Contact is made according to FIG. 3 by cutting each ribbon cable shielding 17 laterally and bending up the first and the second portions 17*a*, 17*b* on the upper surface of the ribbon cable and the lower surface of the ribbon cable, respectively, for establishing full-surface contact with the contact element 12*a*, 12*b*. Any outer insulation 22 present on the ribbon cable 16 is removed before that step.

For establishing the contact, the ribbon cable 16, having been prepared in accordance with FIG. 3, is pushed through the ribbon cable bushing 21 until the at least one portion 17*a*, 17*b* of the ribbon cable shielding 17 is in surface contact with the at least one contact element 12*a*, 12*b*.

According to a simple embodiment, no further measures are needed as the contact between the ribbon cable shielding 17, 17*a*, 17*b* and the contact element 12*a*, 12*b* may already be adequately fixed as a result of the contact established between the lines 18 and the insulation-piercing contact devices 23.

Full shielding is achieved, to the extent possible, if the at least one contact element 12*a*, 12*b* is arranged adjacent to the ribbon cable bushing 21. In the extreme case, the contact element 12*a*, 12*b* may extend almost fully up to the line insulations 19.

It has been assumed so far that at least the first contact element 12*a* is provided for contact-making with the first portion 17*a* of the ribbon cable shielding 17. Preferably, however, both contact elements 12*a*, 12*b* are provided for contact-making with both portions 17*a*, 17*b*. In view of the assembly of the contact element 12*a*, 12*b* on the plug-in connector element 11, separate contact elements 12*a*, 12*b* may be provided.

At least one clamping element 15*a*, 15*b* is provided for fixing the first and/or the second portion 17*a*, 17*b* of the ribbon cable shielding 17. Advantageously, the at least one first clamping element 15*a* and the at least one second clamping element 15*b*, respectively, are provided for both portions 17*a*, 17*b*.

The at least one clamping element 15*a*, 15*b* has a resilient configuration. During assembly of the inventive ribbon cable plug-in connector 10 the clamping element 15*a*, 15*b*, provided for contacting the portions 17*a*, 17*b* of the ribbon cable shielding 17, is initially lifted, which step is followed by pushing the portion 17*a*, 17*b* into its position below the clamping element 15*a*, 15*b*, and the clamping element 15*a*, 15*b* is then released whereby the portion 17*a*, 17*b* of the ribbon cable shielding 17 is fixed on the contact element 12*a*, 12*b* by the resilient force of the clamping element 15*a*, 15*b*. FIG. 4 shows the clamping element 15*a*, 15*b* in the lifted position of the clamping element 15*a*, 15*b*, while FIG. 5 shows it in the released position of the clamping element 15*a*, 15*b*. The lifting of the clamping element 15*a*, 15*b* away from the plane of the contact element 12*a*, 12*b* opposes and overcomes the resilient force provided by the resilient configuration of the clamping element 15*a*, 15*b*. This lifting can be accomplished by hand or other external force (not shown).

According to an advantageous embodiment it is provided that the contact element 12*a*, 12*b* comprises at least one recess 20*a*, 20*b* arranged opposite a clamping element 15*a*, 15*b*. This feature has the effect that the portion 17*a*, 17*b* of the ribbon cable shielding 17 is pressed into the recess 20*a*, 20*b*, at least in part, and is keyed in that position by the clamping element 15*a*, 15*b*. FIG. 5 shows the final position of the clamping element 15*a*, 15*b* after the clamping element 15*a*, 15*b* has been released.

FIG. 6 shows an advantageous embodiment of the first contact element 12*a*, produced from an electrically conductive sheet by punching. Preferably, the at least one recess 20*a* is likewise produced by punching. The remaining portion of the recess 20*a* is formed into the clamping element 15*a*. To this end, the portion remaining after the punching operation may be bent out or away from the plane of the contact element 12*a*, at least somewhat, and may be bent at least slightly at an angle. The separate second contact element 12*b* or else the integrally formed contact element 12*a*, 12*b*, which encloses the ribbon cable 16 in full, may also be produced in the same way. In the illustrated embodiment, the clamping elements 15*a*, 15*b* comprise the narrower portions 24 that facilitate bending of the clamping element 15*a*, 15*b* for fixing the portion 17*a*, 17*b* of the ribbon cable shielding 17.

What is claimed is:

1. A ribbon cable plug-in connector for connecting electronic components comprising (a) a plug-in connector element that comprises a plurality of plug-contacts, (b) a first contact element arranged on the plug-in connector element for full-surface contact-making with an electrically conductive ribbon cable shielding that encloses an outside surface of a ribbon cable, and (c) at least one clamping element which is cut out of the first contact element, is arranged at the first contact element, and is contacting the ribbon cable shielding wherein the at least one clamping element is given a resilient configuration that provides a resilient force onto the conductive ribbon cable shielding, and the conductive ribbon cable shielding is clamped between the at least one clamping element and the first contact element due to the resilient force provided by the at least one clamping element.

2. The ribbon cable plug-in connector as defined in claim 1, further comprising a second contact element, said first contact element being arranged on a first side of a ribbon cable bushing provided in the plug-in connector element, said second contact element being arranged on a second side of the ribbon cable bushing, said first and second contact elements contacting the ribbon cable shielding on an upper surface of the ribbon cable or a lower surface of the ribbon cable, respectively.

3. The ribbon cable plug-in connector as defined in claim 1, wherein the first contact element is arranged adjacent to a ribbon cable bushing provided in the plug-in connector element.

4. The ribbon cable plug-in connector as defined in claim 1, wherein the first contact element comprises at least one recess into which the ribbon cable shielding is pressed by the at least one clamping element.

5. The ribbon cable plug-in element as defined in claim 4, wherein the at least one recess is formed by cutting and bending the at least one clamping element out of the first contact element.

* * * * *